United States Patent [19]

Laverty, Jr.

[11] Patent Number: 4,805,247

[45] Date of Patent: Feb. 21, 1989

[54] APPARATUS FOR PREVENTING UNWANTED OPERATION OF SENSOR ACTIVATED FLUSH VALVES

[75] Inventor: Martin J. Laverty, Jr., Earlyville, Va.

[73] Assignee: Coyne & Delany Co., Charlottesville, Va.

[21] Appl. No.: 35,887

[22] Filed: Apr. 8, 1987

[51] Int. Cl.[4] ..... E03D 13/00; E03D 5/10

[52] U.S. Cl. ..... 4/304; 4/305

[58] Field of Search ..... 4/302, 303, 304, 305, 4/DIG. 3, 249, 623

[56] References Cited

U.S. PATENT DOCUMENTS

| | | | |
|---|---|---|---|
| 3,371,353 | 3/1968 | Filliung | 4/305 |
| 4,309,781 | 1/1982 | Lissau | 4/304 |
| 4,471,498 | 9/1984 | Robertshaw | 4/302 |
| 4,570,272 | 2/1986 | Kawaguchi et al. | 4/302 |
| 4,624,017 | 11/1986 | Foletta | 4/DIG. 3 X |
| 4,667,350 | 5/1987 | Ikenaga et al. | 4/DIG. 3 X |
| 4,742,583 | 5/1988 | Yoshida et al. | 4/304 X |

*Primary Examiner*—Donald Watkins

*Attorney, Agent, or Firm*—McAulay, Fields, Fisher, Goldstein & Nissen

[57] ABSTRACT

A flushing system for a sanitary disposal device, such as a urinal or a water closet, including a flush valve, a flush valve actuator and external controls to control the activation of the flush valve to predetermine the time when the flush valve is rendered operative to be activated, and a sensor responsive circuit responsive to the receipt of infrared rays transmitted or reflected from a particular area or volume relative to the sanitary disposal device for activating the sensor responsive circuit to cause the flush valve to be rendered operative to flush the sanitary disposal device, and a control to provide for adjustment in the field of the particular area or volume which is to render the sensor responsive circuit activated.

20 Claims, 7 Drawing Sheets

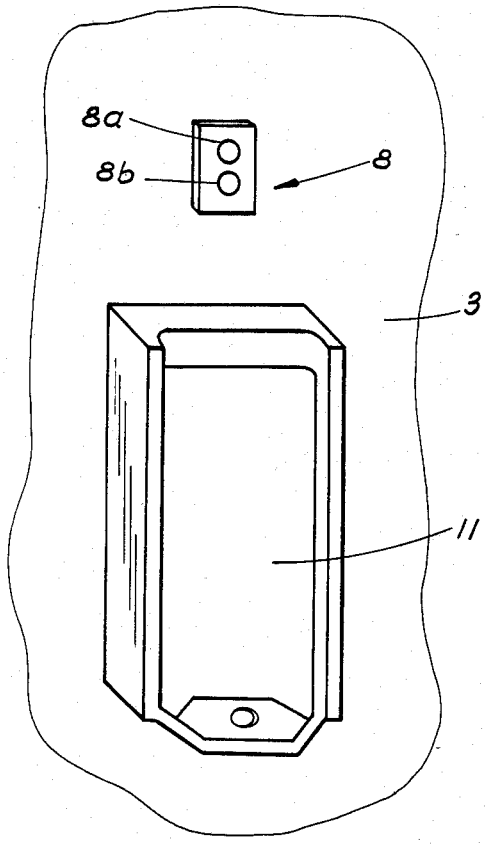
Fig. 1
Fig. 2
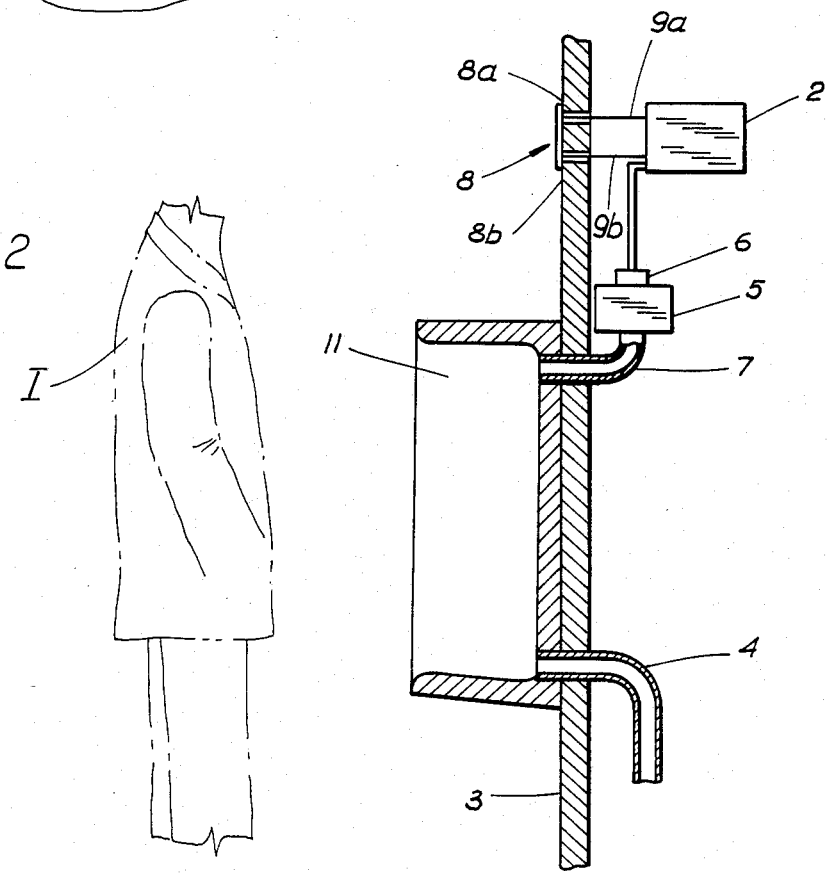

APPARATUS FOR PREVENTING UNWANTED OPERATION OF SENSOR ACTIVATED FLUSH VALVES

BACKGROUND OF THE INVENTION

1. Field of the Invention

This invention is concerned with method and apparatus for preventing unwanted operation of a sensor activated flush valve.

More particularly, the invention is concerned with preventing operation of the sensor activated flush valve when there is a power loss or outage. The invention is also concerned with preventing activation of sensor activated flush valves when power is restored after a power loss or outage.

2. Description of the Prior Art

Heretofore, when a sensor activated flush valve loses power or there is a power outage, the circuitry for the flush valve is rendered operative and all the flush valves in an installation commence operation when power is restored, but since there is insufficient flush water supply to terminate the flushing operation, such flush valves then continue to operate after the power is restored. Other prior art of which applicant is aware are U.S. Pat. Nos. 3,908,204 and 4,309,781.

Heretofore, infrared sensing systems have been used in connection with mechanisms to operate flush valves. Such systems use a single filter through which both the infrared radiation energy is transmitted and reflected both back to a control module.

Also, because of lack of adjustability in connection with some prior art sensing systems, it is not possible to adjust the sensitivity of the receiver as well as the direction of the beam so that the beam may see an unwanted object or false object.

When one lens sees the other, that is, when the lens which receives the reflected light sees the lens transmitting the energy, this creates heat build-up, and the sensor in certain instances will keep the flush valve in a constant working mode and the circuitry therefor can burn itself out. Also, where only one lens is used for transmission and reception, overheating results.

SUMMARY OF THE INVENTION

In order to overcome the aforesaid difficulties, it is proposed to provide a normally open circuit preventor for each rest room, which circuit preventor is open when power is lost and power is restored or supplied after a power failure.

It is also proposed to provide a pre-set timer to turn on and activate the circuit preventor, i.e., to close the circuit preventor from its open condition and place it into its operative condition. As a further feature, it is proposed to have the pre-set timer adjustable so that each rest room can be set at a different predetermined time interval so that simultaneous operation of all circuits is prevented when power is restored.

A time delay circuit may also be provided which includes a resistor-capacitor circuit and a voltage comparing circuit.

A manual operation using a stand-by operator may also be used to set the preferred timing and resetting of the sensor circuits.

More specifically, the present invention proposes the use of five different methods and associated apparatus to provide for pre-selected control of when a flush valve is to be rendered operative.

As indicated heretofore, the present invention is particularly concerned with a sensor activated flush valve with means or circuitry for preventing unwanted operation when the sensor or associated circuitry experiences a loss of current or power and then the power is subsequently restored. Coupled with the sensor is a power-on reset circuit that makes use of a resistor-capacitor network and a voltage threshold comparing device to create a time delay that will inhibit the operation of the flush valve for a nominal time period when current is first supplied to the sensor. Thus, the sensor cannot activate the flush valve until the user steps up to the valve to be used with an infrared light sensor to render a flush valve operative for a flushing operation.

The circuit preventor is desirably a normally open device or switch when power is applied, so that a local operator can exert complete control as to when power restoration is made to ready the urinal or water closet for operation by closing the switch.

When it is desired to have an overriding human control, then a reset button may be provided which is hand engaged. Also, it is possible for certain installations to effect local control of the installation by providing a reset button at each installation. With the power on and the reset button pushed, the circuit preventor will go into its closed or operative position and supply power to the sensor operated flush valve. If the power to the building is interrupted, the circuit preventor will automatically go into its open position.

One circuit preventor can be used with each restroom or installation, or one can be used with a group of rest rooms or installations.

For automatic operation, it is possible to use one circuit preventor with an adjustable timer which will be used with each restroom, and each restroom can be set at a different time interval for preselected installation restoration.

The invention also contemplates improvements in the use of infrared sensing actuators for actuating flush valves. For this purpose, the invention proposes that a separate filter be used for the transmission of infrared radiation energy and a separate filter be used for the reception of infrared energy reflected back from the transmitted infrared energy. Two separate filters are particularly useful in those environments where there is no water and no place to dissipate heat. Also, using two separate filters, one lens cannot see the other lens so that the filters do not stay in a working mode and burn themselves out.

Another advantage in using the separate filters is that if there is vandalism and the filter is scratched or broken, only the filter itself and not the remaining circuitry need be repaired. Also, the circuitry is such that a remote operator can cause the flush valve to be operated if, for some reason, the infrared system is disabled. The filters are separately replaceable.

It is proposed to use two separate filters, rather than a single filter as used heretofore, because if an object is placed in front of the lens, it will see itself. When two separate filters are used, one lens cannot see another lens. When the lens sees itself, this creates heat build-up and stays in the working mode so that it burns itself out, particularly in an environment where there is water and no place to dissipate heat.

The invention also proposes the use of a range adjuster. The reason for the use of a range adjuster is that some stalls for water closets are shorter than others, and the sensor may see the door and activate, which is not wanted. If the sensor sees the door and activates the flushing mechanism, then it is activated and when flushing is desired, the flushing mechanism is not activated. With this invention, it is possible to adjust the range of the sensor and adjustment can take place in the field and not require factory pre-setting. Accordingly, the point of maximum amount of reflected light or energy can be adjusted in the field.

Adjustment of the sensitivity of the receiver and not the direction of the beam is like adjusting a shutter speed on a camera to obtain the ideal point or position of the maximum amount of light reflection.

A wall plate can be used to protect the filters. If one lens is scratched, then only one need be replaced. Use of a wall plate and filters helps to overcome vandalism.

BRIEF DESCRIPTION OF THE DRAWINGS

FIG. 1 is a schematic front elevation view of a sanitary disposal device, such as a urinal with the automatic flushing system and infrared radiation sensor system of the present invention including two separate individual filters installed thereon but obscured from view because it is behind the wall supporting the urinal;

FIG. 2 is a center section taken through the urinal and the infrared detection system of FIG. 1 showing the urinal on the exposed wall and a flush valve and circuitry for operation thereof behind the wall on which the urinal is mounted; this figure also shows an individual in line with the urinal and sensor for activation of the sensor;

DESCRIPTION OF THE PREFERRED EMBODIMENTS

Figure 3:
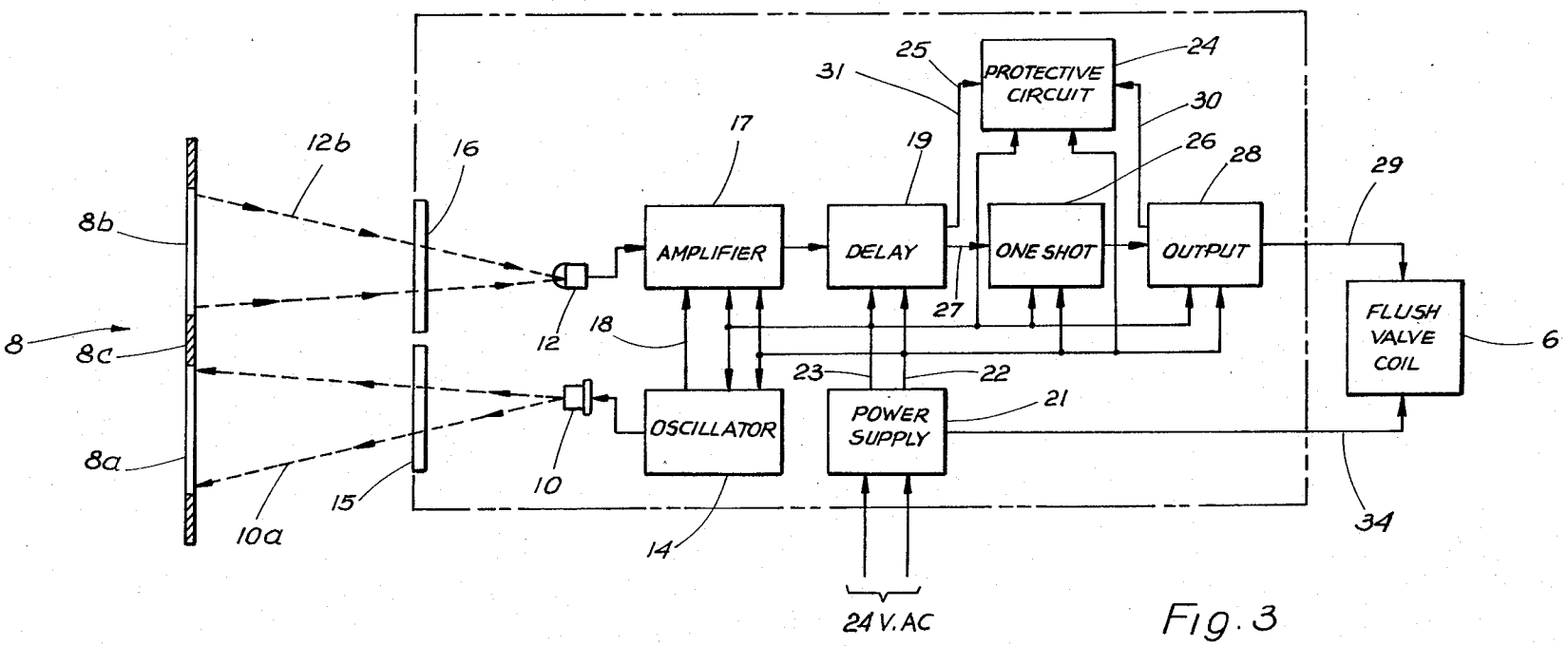
FIG. 3 is a block diagram of one embodiment of a sensor activated circuit for the control circuit or circuitry shown in FIG. 2.

Referring now in particular to FIGS. 1 and 2 of the drawing which shows a conventional sanitary disposal device, such as urinal 1 in combination with an infrared radiation sensor circuitry system 2 in accordance with the present invention. Urinal 1 is positioned on wall 3 together with outlet 4 to drain exhausted spent flush water into a conventional drain (not shown). Flush valve 5 is coupled with system 2 indicated as circuitry and with water quantity control solenoid 6 to generally illustrate the control for flush valve 5. Water inlet 7 to urinal 1 is shown conventionally. Infrared lens transmitter and detector system generally indicated with reference 8 is shown as comprising a first lens **8*a* and a second lens 8*b*, each lens being generally held and supported by wall 3, and while it is shown clearly visible, it can also be hidden from view by a suitable decorating system. Line 9 generally indicates the circuitry from the sensor circuitry system 2 and infrared lens transmitter and detector system 8. Lines 9*a* and 9*b* between lens 8*a* and 8*b*, respectively, circuitry 2 provides for a separate line 9*a* for generally indicating infrared transmission from circuitry 2 to lens 8*a* and a separate line 9*b* for generally indicating reception by circuitry 2 from lens 8*b* of an infrared ray transmitted by circuitry 2 through lens 8*a*, as will be explained further hereinafter. For purposes of the present invention, it is proposed that lenses 8*a* and 8*b* be separate filters and, in effect, isolated from each other so that the only relationship is that 8*b* will receive a reflected ray transmitted from 8*a*** and reflected from a preselected position.

In FIG. 1, the structure not shown, but shown in FIG. 2, is hidden from view and behind wall 3 to prevent unwanted or undesired access thereto. In fact, complete isolation of the operating controls is possible. While it is preferred to have the flush valve hidden and isolated for certain purposes, this is not necessary for the operation. Yet, with respect to the sensor, it is preferred to have this hidden from view to avoid vandalism and/or mischieviousness.

Flush valve 5 is activated by circuitry 2 when solenoid 6 is energized to cause flush water to enter water inlet 5 to flush urinal 1. For this purpose, infrared system 8 will constantly transmit a signal through first filter **8*a* in a direction away from the urinal 1 and when an individual is positioned in front of the urinal 1 for a preselected predetermined period of time, such individual causes the infrared ray transmitted through filter 8*a* to be redirected back towards the wall carrying the urinal 1 and to filter 8*b* for transmission to circuitry 2 through line 9*b* for rendering thereof operative as will be explained, and then leaves, flush valve 5 rendered operative by solenoid 6 to flush urinal 1**.

While the invention is being described in connection with a urinal, it also has equal applicability to a water closet, and the position of the individual or door.

In accordance with the present invention, as noted heretofore, it is proposed to use filters for lens **8*a* and 8*b*. The filter used for lens 8*a* will only permit one-way transmission therethrough of infrared energy towards the individual I shown in phantom in FIG. 2 and the filter used for lens 8*b* will only permit one-way transmission therethrough of reflected or returned infrared radiation energy to be transmitted therethrough from the indicated phantom individual for reception by circuitry 2. The infrared transmitter of circuitry 2 transmits an infrared ray through filter 8*a* and receives a return signal through filter 8*b* applied to the infrared receiver, and when the returned signal ceases, solenoid 6 is energized to operate flush valve 5**, providing that a sufficient quantity of infrared rays are returned or reflected back, as will be explained hereinafter.

When the system is used with a water closet, the door of the cubicle is an integral part of the system and the position thereof is such that it is not at the optimum point where an individual would be expected to be so that the door does not have any effect on the sensor operation, but an individual does at the optimum position. The position of the object or individual I is not shown in FIG. 3, but the range of the optimum position can be adjusted at the factory or in the field and explained in connection with FIG. 5. The range adjustment circuit 38, 39, of FIG. 5 can be used with the present circuit.

The conventional urinal 1 is shown with flush valve 5 and solenoid 6 to operate the flush valve by having flushing water enter the urinal through inlet 7 with outlet 4 to the drain. For safety purposes, it is desired that the flush valve 5, solenoid 6, as well of the inlets and outlets be behind wall 3.

Infrared circuitry 2 is shown positioned behind wall 3 and behind filters 8*a* and 8*b*.

The filters are preferably 880 manometers infrared reddish color material. The filters are ideal for infrared light to pass therethrough.

Referring now to FIG. 3 which shows circuitry 2 including infrared transmitter 10 and infrared receiver 12. Lines 9*a* and 9*b* were general showings of the couplings between transmitter 10 and receiver 12 which are shown here in more detail. Transmitter 10 is coupled to infrared oscillator 14 which generates infrared radiation frequences for transmission by transmitter 10 generally shown as rays 10*a* through opening 15 and through filter 8*a*, and when an individual or other object is placed in front of filter 8*a*, the rays are reflected and redirected to receiver 12 through filter 8*b* through opening 16 and from receiver 12 to amplifier 17.

Openings 15 and 16 are shown together with transmitted rays 10*a* which pass through filter 8*a*. For those rays designated 10*b*, these do not pass through filter 8*b* and, of course, they do not pass through wall portion 8*c*. In a similar manner, reflected rays 12*a* do not pass through filter 8*a*, but reflected rays 12*b* which impinge onto filter 8*b* do pass through filter 8*b* for reception by infrared receiver 12. Of course, those reflected rays which impinge onto wall 12*c* are not received by receiver 12.

Oscillator 14 is coupled with amplifier 17 through strobe line 18 to supply amplifier 17 with a synchronizing input signal, and when a signal is simultaneously received by amplifier 17 from receiver 12, the received signal is amplified and transmitted to delay circuit 19 via line 20. Delay circuit 19 has a predetermined delay to prevent an output thereof.

Power supply 21 is shown as a low voltage power supply, 24 volts A.C., which is used in prior art devices, and powers all units through lines 22, 23.

While 24 volts may be used, it is preferred to use normal conventional supply voltage such as 110 volts A.C. or whatever local power source is available, because all electrical connections and units are isolated from the public and the public has no access to the electrical units so that no hazard due to the type of energy used exists.

Output from delay 19 is applied to protective circuit 24 through line 15 and one-shot arming circuit 26 through line 27. Output circuit 28 is provided to isolate flush valve coil or solenoid 6 for flush valve 5. Flush valve coil 6 is energized when output 28 together with power supply 21 through lines 29, 30 respectively complete the circuit through coil 6. For this purpose, both protective circuit 24 and one-shot arming circuit 26 must be operative and cooperate to render output 28 in circuit with power supply 21 through coil 6. The circuitry here, except for protective circuit 24 and the interconnection thereof with the other circuits, except for and the use of filters instead of a single filter as well as the locally available power source use, is conventional and is known from U.S. Pat. No. 4,309,781.

The ability to use a local available power source as well as the use of filters instead of a single two-way lens has been explained heretofore.

The novel protective circuit 24 is powered from power supply 21 through lines 22, 23 and the output from output 28 can be directed either through line 29 or line 30. When directed through line 30, coil 6 is maintained inoperative. Protective circuit 24 has two inputs; one input is through line 31 from delay 19, and the other is through line 30 from output 28. Delay circuit 19 is effective to control protective circuit 24 so that constant flushing does not take place and a periodic delay is imparted to take care of transient activation of amplifier 17.

Figure 4:
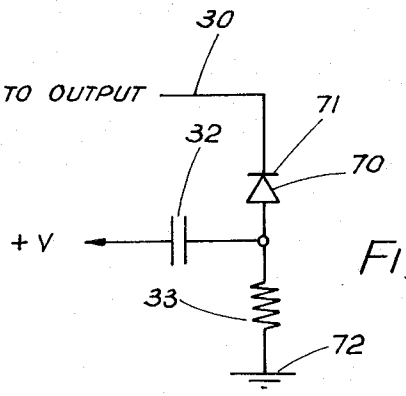
FIG. 4 is a wiring diagram of the protective circuit of the circuitry shown in FIG. 3 to prevent flushing after there is an outage and it is desired to re-activate all the flush valves.

FIG. 4 illustrates one specific type of circuit for use as protective circuit 24 and includes diode 70 having its plate 71 coupled to output 28 through line 30 and its other side coupled to a positive voltage potential V+ through capacitor 32 forming an R-C circuit with resistor 33 which has one end connected to ground 72 or at a suitable reference potential and the other end connected to the junction between diode 70 and resistor 32 - capacitor 33.

Protective circuit 24 is used to control the operation of flush valve 5 by controlling whether coil 6 is energized as a result of infrared receiver 12 receiving reflected rays transmitted from transmitter 10. When a separate voltage such as voltage V+ is applied to protective circuit 24 across R-C network 32–33, current is caused to flow through diode 70 preventing any reverse flow from output 28 through line 30 to protective circuit 24. When voltage V+ is removed, whether through a power failure or intentionally, no further current flows through diode 70 in the forward direction through line 30 and there is no opposition to any current flow through line 30 so that no current flows through lines 29, 34 and flush valve coil 6, or an insufficient amount flows therethrough to energize solenoid 6, and the flush system is thereby disabled. Protective circuit 24 is operative to determine whether a circuit from output 28 through line 29 through flush valve coil 6 and line 34 from power source 21 is effective to energize flush valve coil 6. When protective circuit 24 is operative to prevent current from power supply 21 to energize flush valve coil 6, then no flushing operation takes place.

Restoration of voltage V+ may be selectively carried out so that each installation, and/or each urinal in each installation, may be selectively activated and readied for flushing. In some situations, after a power failure, when power is restored, all or some of the flush valves will be in an operating condition and thereby cause a shortage in water supply. The protective circuit 24 is intended to prevent this and to exert a control over the time and sequence, if desired, when each of the flush valves is restored into their ready condition for operation. If all the flush valves are operating at the same time, then there is an insufficient quantity of water going through each flush valve to shut it off after a flushing cycle is completed.

Resistor 33 may suitably be 100K ohms and capacitor 32 may suitably be 1 $\mu$f, and voltage V+ may be 24 volts D.C. or a rectified conventional local supply A.C. voltage.

Figure 5:
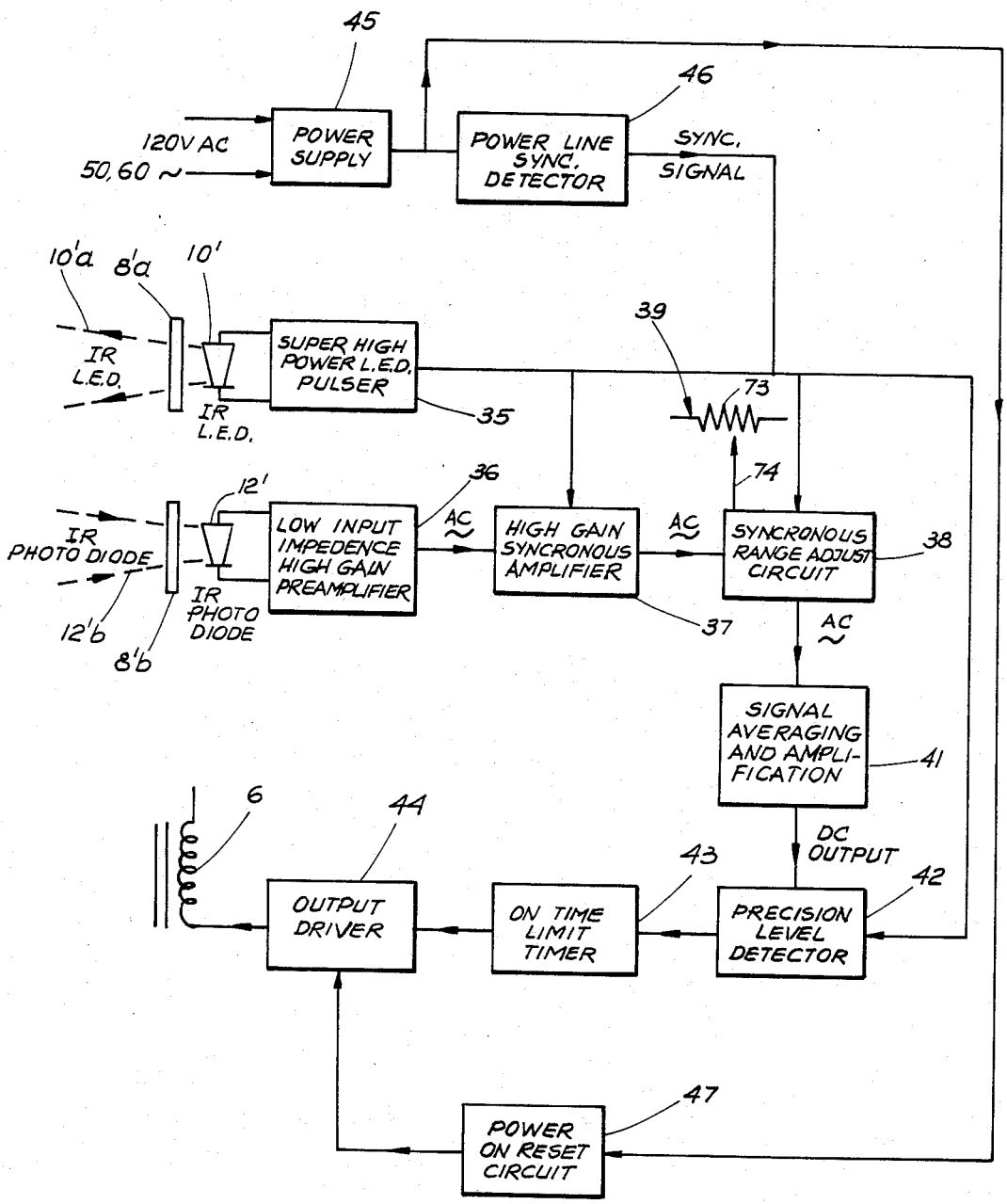
FIG. 5 shows another embodiment of a sensor activated circuit.

Referring to FIG. 5 which illustrates another preferred embodiment of the invention which proposes an infrared sensor activated circuit associated with a flush valve to provide for a control to prevent unwanted operation when the sensor experiences a loss of power. nInfrared transmitter 10' in the form of a light emitting diode is coupled with a super high power L.E.D. pulser 35 to generate infrared pulses, and an infrared receiver 12' in the form of a photo diode is used to receive reflected pulses which impinge onto a body and were transmitted from transmitter 10'. A low input impedance high gain preamplifier receives pulses or signals from the receiver 12' and together with high gain synchronous amplifier 37 amplifies the received signals. Synchronous range adjustment circuit 38 includes a range adjuster 39 to provide for adjustment of the number of signals or pulses to be returned to diode 12' so that flushing will only take place when a predetermined elapsed period of time has taken place. Signal averaging and amplification circuit 41 takes the A.C. output from range adjustment responsive circuit 38 and converts this to a D.C. output with a predetermined amplitude for activating precision level detector 42 which is coupled to an on-time limit timer 43 to control the length of time to flush the urinal or water closet. Output driver 44 is coupled to solenoid valve 6 for the control and energization thereof. Range adjuster 39 provides for the length of time necessary for the infrared radiation to be reflected before solenoid is energized to operate solenoid valve 6.

Range adjuster 39 is generally shown as a resistor 73 and adjustment selector 74 which can be varied in the field or at the installation so that it does not have to be preset at the factory.

Range adjuster 39 also provides for the selection distance that the infrared radiation 10'*a* is transmitted from infrared transmitter 10' through filter 8'*a* and the range of a preselected area from which area reflected infrared rays 12'*b* are returned to infrared photo-diode receiver 12' through filter 8'*b*. In effect, a certain volumetric area is predetermined to activate the receiving sensors.

With the range adjuster 39, it is possible to use different size water closets and urinals. In this way, a certain predetermined distance or a range of distances from the urinal, as well as height above the floor and distance from the ceiling, can be selected so as to have the receiver receptive, such as having a certain range in focus for a camera lens. The out-of-focus portions surrounding the urinal or water closet will not activate the flush valve, and can be selected to provide for the desired quantity of returned reflected infrared rays. It is also possible to vary the size of the stall for a water closet so that no flushing of the flush valve will take place if rays are reflected back by an object or human who is not within the preset predetermined range of either the urinal or the water closet.

In the situation where the infrared sensor is used in connection with a water closet, the sensor may see the door to the stall, and this is not what is wanted to activate the flush device, so that the flushometer will never be rendered operative unless, of course, someone is within the preselected volume to trigger the flush valve. By adjusting the sensitivity of the receiver and not the direction of the beam or the amount of light transmitted is analogous to the adjustment of a shutter on a camera. The range adjuster 39 is adjustable so that ideal points or ranges are selected from which the infrared radiation is to be received or reflected back.

On time limit timer 43 is used to determine the length of time a flush will take place as well as intervals between flushes. This is a water conservation device so that excess water is not used.

This circuit operates on a conventional power source, such as a one-hundred-ten to a one-hundred-twenty volts A.C. power supply 45, although 24 volts D.C. or any other power source may also be used. Coupled with power supply 45 is power line synchronous detector 46 to power the operating circuitry for the infrared sensor and their related circuitry.

To the aforesaid circuit, the present invention also adds a power-on reset circuit 47 which can be manually or automatically operated. When manually operated, the operator can determine, depending on the circuitry and individual connections, which urinal or groups of urinals or installations will be readied for flushing. Power-on reset circuit 47 has absolute control over output driver 44 so that when output driver 44 receives a signal transmitted from receiving photo diode 12', output driver 44 will only be conductive to energize solenoid valve 6, shown schematically, when power-on reset circuit 47 is operative. Hence, output driver 44 may be considered to be an "and" circuit requiring two controls.

Figure 6:
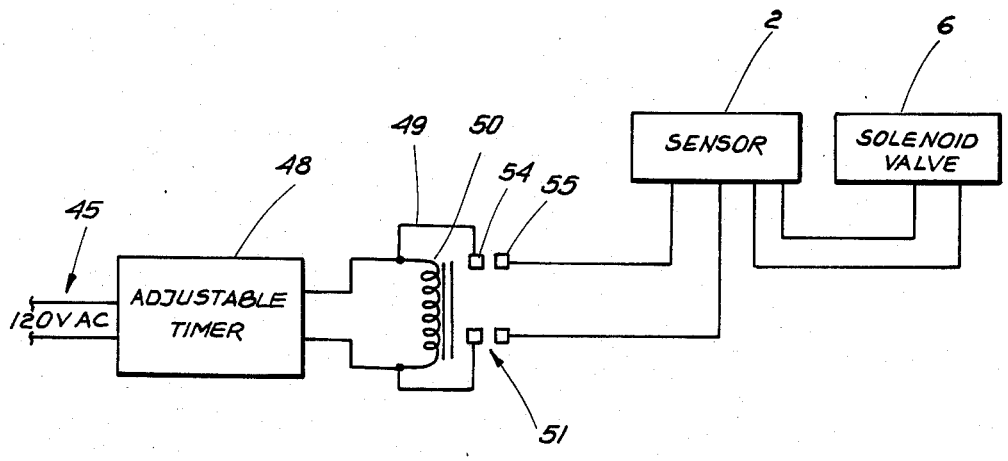
FIGS. 6 and 7 illustrate one embodiment of a timer control circuit in an unlatched and latched condition to control or override an infrared sensor activated solenoid flush valve.
Figure 7:
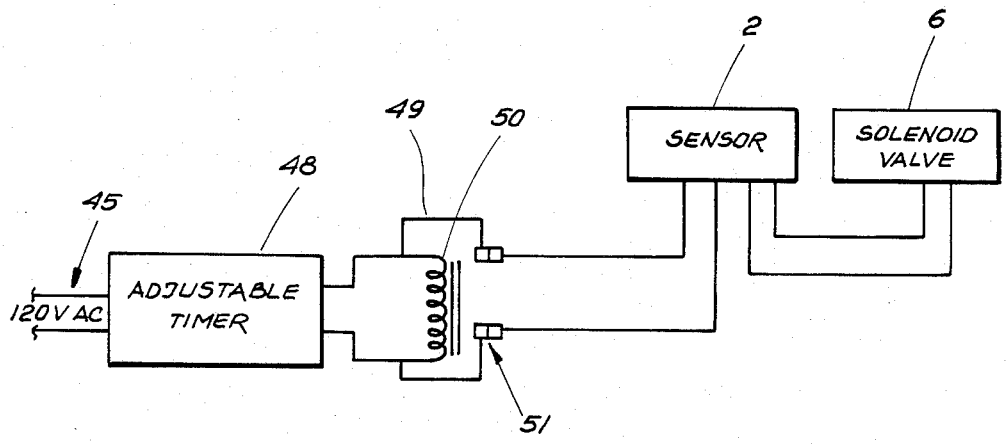

Referring to FIGS. 6 and 7 which illustrate a simplified control circuit, and generally schematically illustrates an infrared sensor system 2 for activating a urinal or water closet flush valve, solenoid operated solenoid valve 6. Adjustable timer 48 is coupled with a conventional 120 volts A.C. power supply 45. Timer 48 is adjustable so that latching mechanism 49 which includes solenoid coil 50 is periodically energized or controlled to control the quantity of flush water as well as the recycling time of the flush valve. FIG. 6 shows the circuitry in its inoperative or non-flush condition with contact 51 composed of contacts 54 connected to latching mechanism 49 disengaged from contacts 55 connected with sensor 2, and FIG. 7 shows the circuitry in its operative condition with contacts 54 engaged with contacts 55 to provide for flushing in response to sensor activation.

Figure 9:
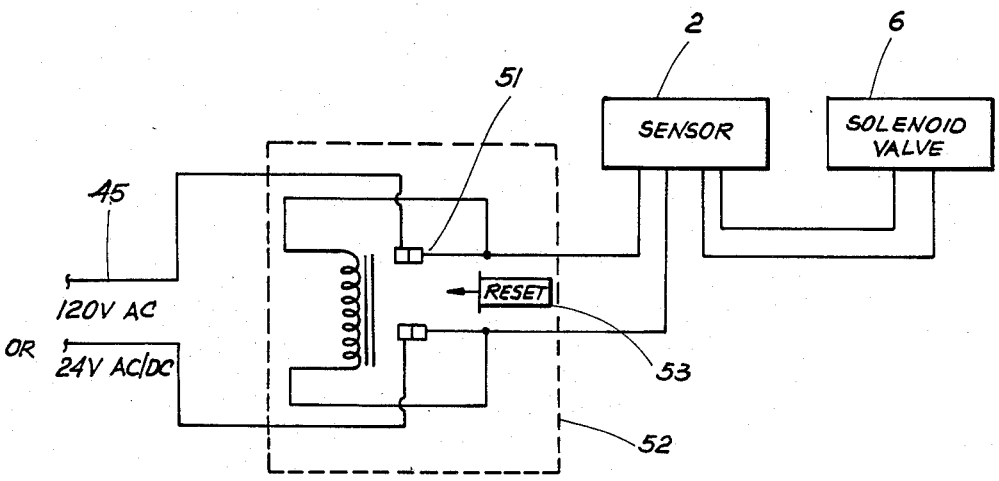
FIGS. 8 and 9 show another embodiment of the invention including a circuit preventor requiring at least one control and possibly two controls to reset and ready the infrared sensor for activation of the flush valve.
Figure 8:
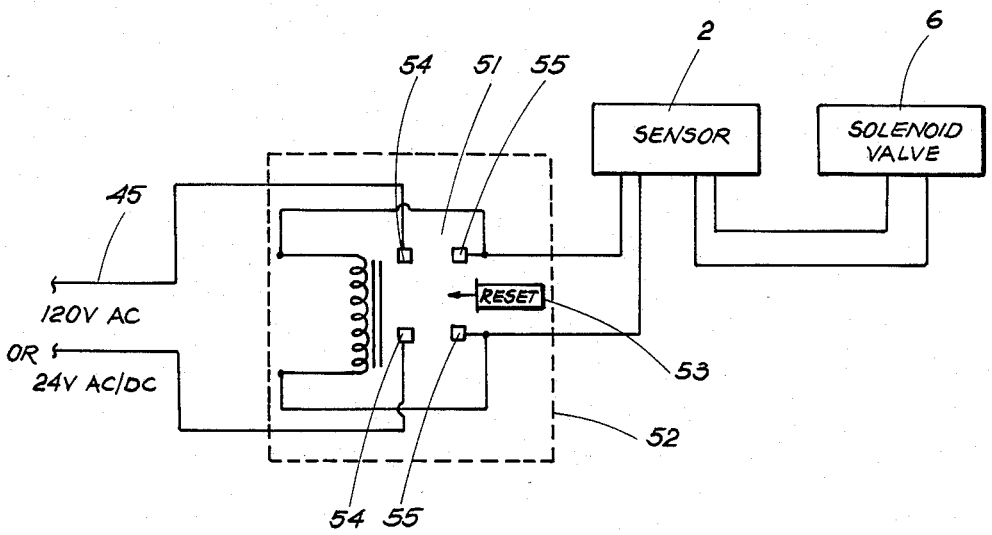

Referring now to FIGS. 8 and 9 which illustrate a circuit preventor 52 and a reset switch 53 in combination with a sensor activated solenoid flush valve 6.

Circuit preventor 52 includes contact set 51 and reset switch 53. Reset switch 53 may be publicly accessible or closed-off from the public. Reset switch 53 is movable to cause contacts 54, 55 to be energized as shown in FIG. 9. With reset switch 53, it is possible to render each sensor 2 for each installation operative after power is restored due to a power failure so that there are at least one and possibly two controls. One control is from the central station, as in FIGS. 6 and 7, and the second control is the reset switch 53 at the local location.

Figure 10:
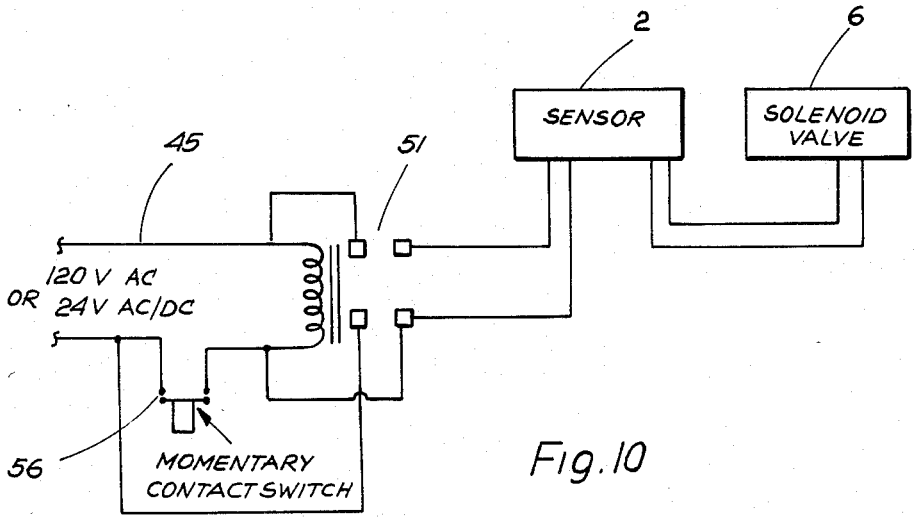
FIGS. 10 and 11 show another embodiment of the invention to control the resetting of the operation after a power outage.
Figure 11:
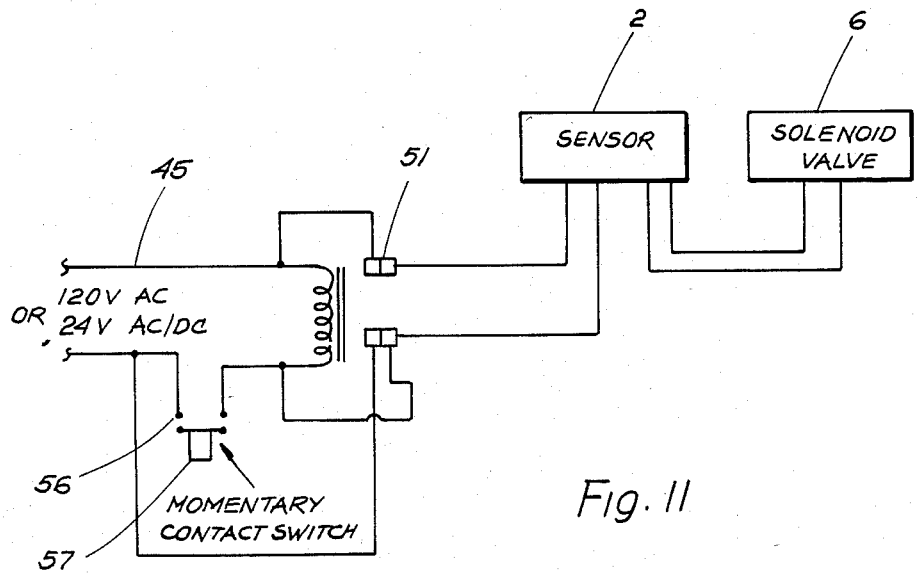

Referring to FIGS. 10 and 11, which illustrate another embodiment of the invention to render sensor 2 capable of being activated. Control switch 56 which includes a push button 57 provides for contact for a short period of time. Push botton 57 is used to engage the contacts of control switch 56.

Figure 12:
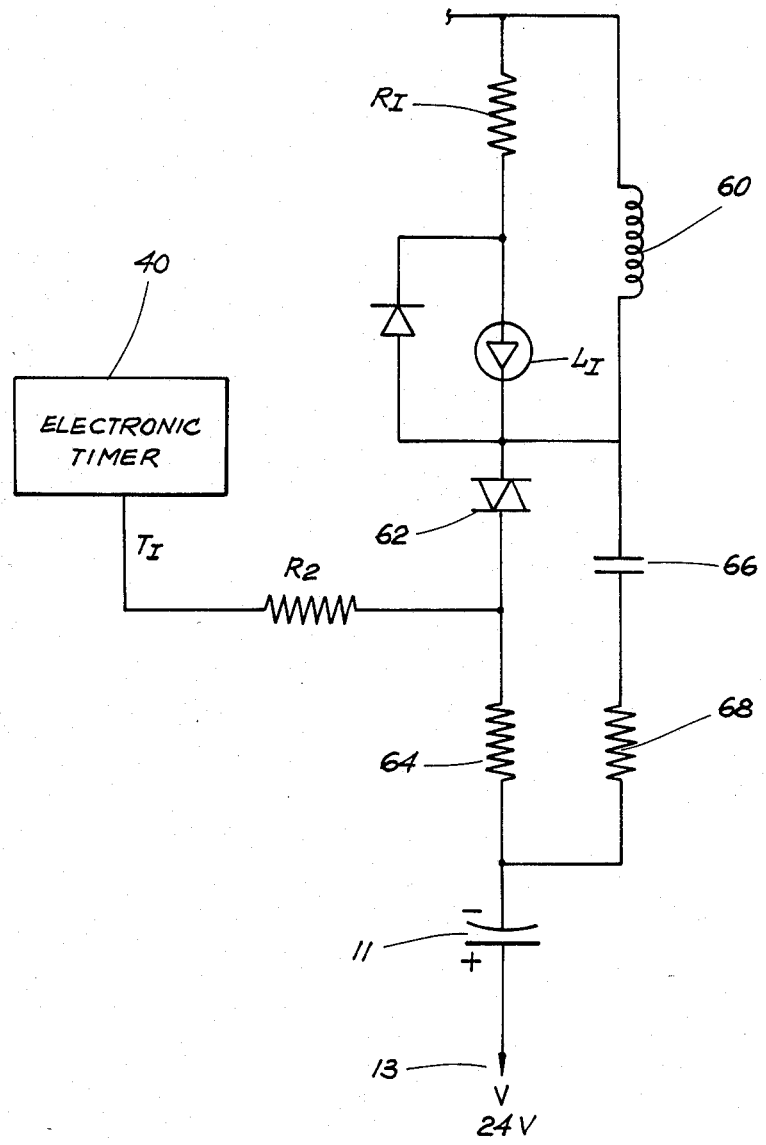
FIG. 12 is a partial wiring diagram of a prior art circuit modified in accordance with the teachings of this invention to control the restoration of each urinal and/or for each installation to control when flush water is to be supplied.

Referring now more particularly to FIG. 12 of the drawings which illustrates a portion of a prior art circuitry and one of my presently preferred modes of carrying out the invention, and in particular to a portion of the circuit in a typical prior art installation, such as that shown in FIG. 1 of U.S. Pat. No. 3,908,204 for an electronically controlled water closet, and in which the reference numerals used in the aforesaid patent are also used herein. For completeness of disclosure, the aforesaid U.S. Pat. No. 3,908,204 to Hopkins is incorporated by reference.

In order to provide for a preselected control for rendering inlet valve 60, generally shown and exemplified as a coil, capable or incapable of supplying flush water, this invention proposes a control comprising the addition to such circuit of a variable capacitor 11 connected at the junction of resistors 64, 68 for connection to triac 62 so as to render it non-conductive when electronic timer 40 transmits signal $T_I$ to triac 62 to render it conductive for causing inlet valve 60 to open for the preselected period of time. Variable capacitor 11 has one plate, its negative plate coupled through resistor 64 to triac 62 and its positive terminal to a 24 volts D.C. power supply 13. Variable capacitor 11 is usable to supply 24 volts D.C. in opposition to the signal from timer 40 to either enable the triac 62 to be responsive to electronic timer 40 or to be rendered non-responsive to timer 40. While this circuit shows a 24-volts D.C. power source, just by changing the values of the circuit components appropriately, any other suitable power supply may be used.

There are certain adjustments which should be taken into consideration when using the various circuits and embodiments. For example, stalls for water closets are designed differently; they may be shorter or longer. Sensors should not see the door, and the range can be adjusted so that the height intercepted as well as the range of distances from the floor as well as the distance from the sensor can be changed.

The circuit can also be adjusted so that it looks at different spectrums of light. Adjustments take out the light that it does not want and focus on the infrared light. The detector or receiver is to be adjusted to the ambient light conditions.

Switches and power supplies can be either a 24 volt component or a 110 volt unit because it is away from the persons using the urinal or water closet, and there is no contact with the urinal. In any event, safety switches can be used to prevent grounding of the user.

The power reset circuit is a resistor-capacitor network and not an integrating circuit.

If current is interrupted or lightning strikes, without use of the invention in the prior art circuitry, every flush valve will flush and there is not enough water to shut the flush valves off. Even if there are only twenty valves, there is not enough water to close the valves. Certain prior art valves need 35 gallons per minute to shut off. Presently, there is a problem if the water pipe is broken, then every flush valve will also try to flush.

When power is put to the sensor, it holds sensor in the "off" mode. If light goes off momentarily, not one flush valve would operate. It will always be in the "off" mode until someone stands in front of it. There are means for preventing with a time delay, and it inhibits when power is first applied.

The automatic circuit preventor is normally open and can be engaged by hand to apply power to each rest room. A circuit preventor may be used for each rest room, and a circuit preventor may also be provided in the breaker panel.

While there has been shown and described what is considered to be the preferred embodiments, various changes and modifications may be made without departing from the scope of the invention.

What is claimed is:

1. An automatic flushing system, comprising:

means for activating a flush valve to flush a sanitary disposal device, said activating means including first and second infrared filters to prevent the system from staying in its armed or working mode and burning itself out; and an infrared sensor activated circuit for transmitting an infrared signal through said first filter and receiving a reflection of said frared signal through said second filter to activate the flush valve responsive to the reflection of the infrared signal received through said second filter.

2. The system of claim 1, including:

means externally controlled including an automatic circuit preventor to control said activating means to predetermined the time when said activating means is rendered operative to render said flush valve operable;

said externally controlled means being subject to human intervention to apply power to said sensor circuit after a power fault.

3. The flushing system of claim 2, including a sensor associated with said sensor-activated circuit, and wherein said externally controlled means includes means to hold said sensor in its off-mode.

4. The flushing system of claim 1, wherein said flush valve and said sensor activated circuit are power operated and rendered inoperative in response to a cut-off of power, and including an R-C circuit in circuit with said infrared sensor activated circuit for preventing reactivation of said sensor circuit after a power loss or a cut-off of power.

5. The flushing system of claim 2, wherein said flush valve and said sensor activated circuit are power operated and rendered inoperative in response to a cut-off of power, and including an R-C circuit in circuit with said infrared sensor activated circuit for preventing reactivation of said sensor circuit after a power loss or a cut-off of power.

6. The system of claim 18, including an R-C circuit in circuit with said infrared sensor activated circuit for preventing reactivation of said sensor circuit after a removal of power.

7. An automatic flushing system for a sanitary disposal device such as a urinal or a water closet, comprising:

infrared sensor responsive means for activating a sensor responsive flush valve to flush the sanitary disposal device;

means externally controlled including an overriding control to control said activating means to predetermine the time after a power fault when said sensor activating means is rendered receptive to be rendered operative to render said flush valve operable; and means responsive to restoration of power after the power fault to cause said sensor responsive flush valve to rest in the valve-off condition to thereby provide for the valve to resume operation when normally actuated.

8. The system according to claim 7 for at least two restrooms, each said restroom having at least one said sanitary disposal device, wherein said externally controlled means includes a normally open circuit preventor for each said restroom, and means to close said open circuit preventor selectively to control when each said restroom is rendered ready for the flush valve to be rendered operative in response to activation by said infrared sensor.

9. The system of claim 8, wherein said externally controlled means includes a normally open circuit preventor for each said restroom, and means to close said open circuit preventor selectively to control when each said restroom is rendered ready for the flush valve to be rendered operative in response to activation by said infrared sensor.

10. The flushing system according to claim 7, including a range adjuster for adjusting the spacing within which reflected signals are effective to activate said sensor activated circuit.

11. The flushing system according to claim 10, wherein said range adjuster includes means to adjust the sensitivity of the receiver of said sensor activated circuit.

12. The flushing system according to claim 1, including a range adjuster for adjusting the spacing from the floor and from the sanitary disposal device to provide for a first range from the sanitary disposal device and a second range from the floor within which ranges said sensor activated circuit is responsive to the reflection of the infrared signal received through said second filter.

13. The system of claim 1 for use in connection with an installation having more than one urinal or water closet, each functioning as a santiary disposal device, and each said sanitary disposal device having a flush valve associated therewith, including an individual reset for each said sanitary disposal device for rendering the flush valve associated therewith operative.

14. The system of claim 1, wherein said system includes a plurality of installations, each said installation having at least one sanitary disposal device means separately controlling each of said installations.

15. The automatic system of claim 1 for at least two installations each having at least one urinal or water closet, and a flush valve associated with each said urinal and water closet, said flush valves being electrically power operated and including a time delay circuit operatively associated with said flush valve for creating a time delay to prevent simultaneous operation of all flush valves when power is restored.

16. The automatic system of claim 15, wherein said time delay circuit includes a resistance-capacitor network.

17. The system according to claim 1, including a preset timer for each restroom, and means to adjust said preset timer to control the time elapse after power is turned on to activate-the flush valve.

18. The system according to claim 1, for at least two restrooms including a, time delay circuit and a voltage comparing circuit for delaying resetting of the flush valve operation, said voltage comparing circuit rendering the flush valve operative after the time delay circuit reaches a predetermined pre-set voltage.

19. The flushing system according to claim 1, including a range adjuster for adjusting the spacing within which reflected signals are effective to activate said sensor activated circuit.

20. An automatic flushing system, comprising:

means for activating a flush valve to flush a sanitary disposal device, said activating means including first and second infrared sensors;

an infrared sensor activated circuit for transmitting an infrared signal from said first sensor and receiving a reflection of said infrared signal by said second sensor to activate the flush valve responsive to the reflection of the infrared signal received by said second sensor; and means externally controlled including an overriding control to control said activating means to predetermine the time after a power fault when said activating means is rendered operative to render said flush valve operable.

* * * * *

UNITED STATES PATENT AND TRADEMARK OFFICE

CERTIFICATE OF CORRECTION

PATENT NO. : 4,805,247

DATED : February 21, 1989

INVENTOR(S) : Martin J. Laverty, Jr.

It is certified that error appears in the above—identified patent and that said Letters Patent is hereby corrected as shown below:

Column 10, line 12, change "frared" to --infrared--.

Claim 18, line 2, change "a," to --a--.

Signed and Sealed this

Seventeenth Day of April, 1990

*Attest:*

*Attesting Officer*

HARRY F. MANBECK, JR.

*Commissioner of Patents and Trademarks*